United States Patent [19]

Spinos et al.

[11] Patent Number: 5,009,083

[45] Date of Patent: Apr. 23, 1991

[54] BEVERAGE COOLER

[76] Inventors: Frank T. Spinos, 3455 Lebon, #1631, San Diego, Calif. 92122; Sharon M. Worley, 3549 Castle Glen Dr., #226, San Diego, Calif. 92123

[21] Appl. No.: 447,227

[22] Filed: Dec. 6, 1989

[51] Int. Cl.[5] ..... B67D 5/62

[52] U.S. Cl. ..... 62/400; 62/457.3

[58] Field of Search ..... 62/294, 457.2, 457.3, 62/400, 1

[56] References Cited

U.S. PATENT DOCUMENTS

| | | | |
|---|---|---|---|
| 929,389 | 7/1909 | Clement | 62/457.3 |
| 2,075,831 | 4/1937 | Schlumbohm | 62/400 X |
| 2,088,376 | 7/1937 | Kaskey | 62/400 X |
| 3,840,153 | 10/1974 | Devlin | 222/146 C |
| 3,998,072 | 12/1976 | Shaw | 62/457 |
| 4,163,374 | 8/1979 | Moore et al. | 62/457 |
| 4,183,226 | 1/1980 | Moore | 62/457 |
| 4,204,613 | 5/1980 | Terzian et al. | 62/400 X |
| 4,240,271 | 12/1980 | Brownlow | 62/457 |
| 4,281,520 | 8/1981 | Norwood | 62/371 |
| 4,324,111 | 4/1982 | Edwards | 62/457 |
| 4,344,300 | 8/1982 | Taylor | 62/457 |
| 4,357,809 | 11/1982 | Held et al. | 62/457 |
| 4,478,346 | 10/1984 | Spong | 62/400 X |
| 4,517,815 | 5/1985 | Basso | 62/457 |
| 4,599,872 | 7/1986 | Rist | 62/400 X |
| 4,608,837 | 9/1986 | Hickey et al. | 62/400 |
| 4,886,176 | 12/1989 | Steakley | 62/400 X |

*Primary Examiner*—Lloyd L. King

*Attorney, Agent, or Firm*—Fulwider, Patton, Lee & Utecht

[57] ABSTRACT

A beverage cooler having an inner container disposed within an outer container to define an annular chamber for holding a beverage. The inner container contains a refrigerant, and includes a drinking straw passageway for withdrawing the beverage. The refrigerant cools the main body of the beverage, and further chills the beverage portion as it is being withdrawn through the passageway.

8 Claims, 2 Drawing Sheets

BEVERAGE COOLER

BACKGROUND OF THE INVENTION

1. Field of the Invention

This invention relates to beverage coolers, and more particularly to a portable cooler for chilling a beverage.

2. Description of the Prior Art

Various devices are known for keeping a beverage in a chilled state. These include a cup having polystyrene insulating walls. The rate at which the main body of the beverage absorbs heat from the environment is reduced, but the cup is ineffective to chill the beverage.

U.S. Pat. No. 4,357,809 discloses a beverage holder in which a peripheral annular wall compartment contains a freezable refrigerant to cool the beverage in the holder. However, there is a substantially direct absorption of heat from the environment by the refrigerant because one side of the wall compartment forms the outside of the holder. In addition, the thickness of the wall compartment makes the holder too bulky for convenient use as a portable drinking utensil. Moreover, the entire holder must be placed in a refrigerator to cool the refrigerant.

A replaceable refrigerant capsule is disclosed in U.S. Pat. No. 3,840,153. The capsule fits within a beverage chamber defined within a flexible or squeezable drinking utensil. A dispensing tube is also located in the beverage chamber in spaced apart relation to the refrigerant capsule. The cooled beverage is discharged from the tube when the utensil is squeezed.

A major drawback of this design is that there is only localized cooling of the beverage adjacent the refrigerant capsule and the beverage must be continuously agitated or mixed to provide uniform cooling. The design undesirably comprises a considerable number of components which are costly to manufacture and assemble and inconvenient to clean.

It is desirable for a beverage cooler to provide specific or localized cooling of the beverage portion being dispensed to a temperature below the temperature of the main body of the beverage. It is also desirable that the cooler comprise relatively few components which can be easily manufactured and assembled, and which are easy to clean.

SUMMARY OF THE INVENTION

According to the present invention, a beverage cooler is provided which comprises a bottle or container having walls which define a chamber for receiving the beverage. There is a second container within this chamber which has inner walls which define an elongated tubular passageway. The lower end of the passageway is in fluid communication with the bottom of the beverage chamber.

The outer walls of the second container define a compartment surrounding the passageway. The compartment is adapted to receive a heat transfer medium to effect substantially direct heat transfer relative to the portion of the beverage which passes through the tubular passageway.

A drinking straw is receivable within the passageway to enable withdrawal of the beverage through the passageway.

The heat transfer medium typically is a refrigerant such as frozen water or water based gel material for absorbing heat from the beverage. The second container is removable from the first container for chilling or freezing the refrigerant in a refrigerator or freezer.

In one embodiment the second container is suspended within the first container and is secured in position by threaded attachment to a cap or top. In another embodiment, the upper extremity of the second container includes a flange for seating on the first container. It is held in this position by interengagement between the top and the first container.

The top has an opening in alignment with the passageway in the second container for insertion of the drinking straw. The straw extends below the passageway for withdrawal of the beverage from the lower portion of the beverage chamber.

The second container may be formed of inner and outer tubular members. The outer tubular member includes the flange previously mentioned, while the inner tubular member is located coaxially within the outer tubular member. The lower portion of the inner tubular member extends beyond the outer tubular member into the bottom of the beverage chamber. Both the outer and inner tubular members have cooperative or complemental portions which releasably snap or fit together to seal the refrigerant compartment.

DESCRIPTION OF THE PREFERRED EMBODIMENTS

Figure 1:
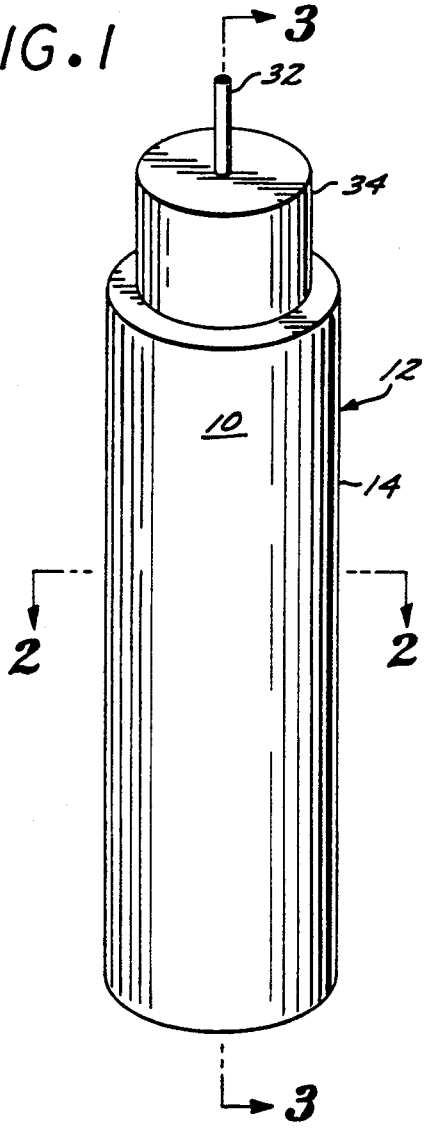
FIG. 1 is a perspective view of the beverage cooler of this invention.
Figure 2:
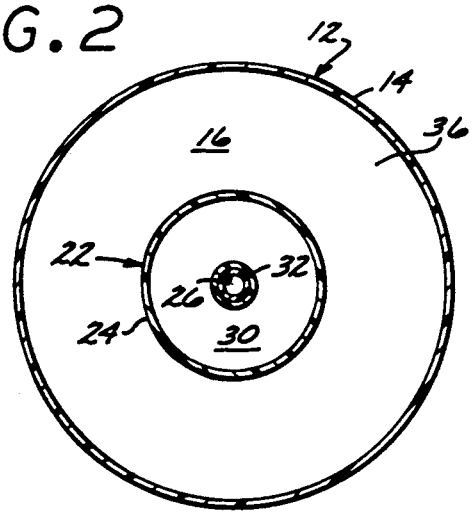
FIG. 2 is an enlarged transverse cross sectional view taken from line 2—2 of FIG. 1.
Figure 3:
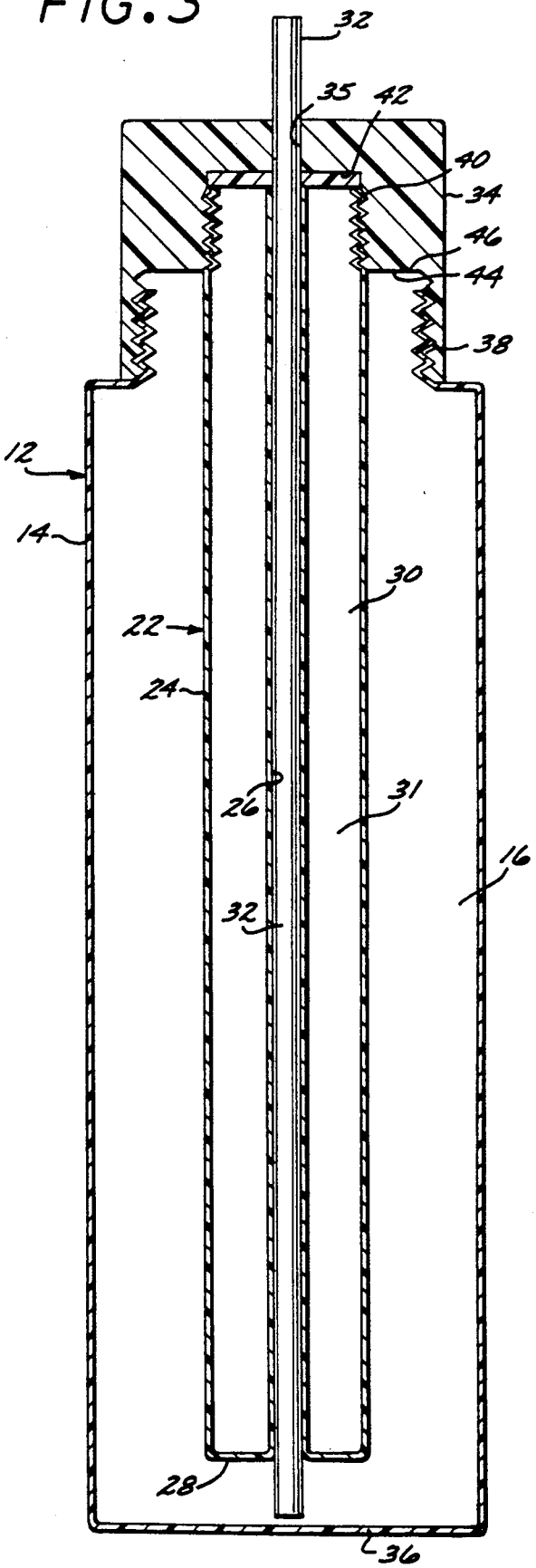
FIG. 3 is an enlarged longitudinal cross sectional view taken from line 3—3 of FIG. 1.

The beverage cooler of the invention is a conveniently portable, easily cleanable and highly efficient cooler for holding and chilling a beverage. As shown in FIGS. 1-3, the beverage cooler 10 includes an elongated first or outer bottle or container 12 having a closed bottom or base 36 and a cylindrical wall 14.

An elongated second or inner container 22 having a base 28 and a cylindrical wall 24 is coaxially disposed within the container 12. The base 28 is spaced above the base 36, and the walls 14 and 24 define an annular enclosure or chamber 16 for holding a beverage.

The container 22 includes a tubular central portion having a passageway 26 which opens through the base 28 into fluid communication with the beverage to be held in chamber 16.

The passageway 26 is adapted to receive a drinking straw 32 so that the straw extends beyond the base 28 for withdrawal of beverage from the space defined between the bases 28 and 36, as shown in FIG. 3.

Although the passageway 26 is shown as straight in FIGS. 10-3 to accommodate an elongated drinking straw, other configurations such as a spiral can be used to accommodate drinking straws of different configurations.

An annular space 30 is defined in the inner container 22 between the wall 24 and the tubular central portion which defines the passageway 26. The space 30 is adapted to receive a heat transfer medium such as a refrigerant taking the form of a water based gel material, distilled water or the like.

Although the medium is referred to as a cooling medium, and the present device is referred to as a cooler, these terms are employed for convenience, since the medium could be a heated medium to maintain the beverage in a heated state. The claims which follow should be interpreted accordingly.

Since the inner container 22 is immersed in the beverage within chamber 16, there is a relatively large heat transfer area between the inner container and the beverage. Further, the beverage insulates the cold inner container 22 from the outside environment, and thereby reduces direct heat exchange between the refrigerant and the environment.

A cylindrical cap or top 34 mounts the inner container 22 and closes the upper end of the outer container 12. The top 34 and the upper extremity of the outer container 12 are provided with threads 38 which interfit. The use of threads is merely exemplary and other means for mounting the top upon the outer container can be used if desired.

As seen in FIG. 3, the upper end of the inner container 22 is attached to and is demountably suspended from the top 34 by complemental threads 40. The inner container 22 is shorter than the outer container so that the passageway 28 opens into the beverage chamber portion at the bottom of the cooler.

The top 34 also includes a central opening 35 through which a straw can be disposed for extension through the passageway 26. The opening 35 and passageway 26 are slightly larger than the straw to permit outside air to enter the beverage cooler as beverage is being withdrawn. This equalizes the pressure between the inside and outside of the beverage cooler.

Heat transfer between the refrigerant and the main body of the beverage takes place across the wall 24 of the inner container 22. However, there is also a heat transfer between the refrigerant and that portion of the beverage which will be or is being withdrawn through the passageway 26. Such heat transfer occurs across the wall defining the passageway and, since the wall is elongated a substantial distance, the beverage being withdrawn will be cooled along the whole length of the passageway. This typically results in chilling below the temperature of the main body of the beverage in chamber 16. Thus, the beverage cooler 10 offers maximum heat transfer efficiency between the refrigerant and the beverage, and provides additional chilling of the beverage being withdrawn.

The outer container is preferably made of a plastic material which is chemically inert and easily cleaned. The plastic material can be made flexible so that squeezing of the outer container will develop an internal pressure sufficient to force beverage out of the container or facilitate sucking the beverage through the straw.

The inner container 22 is also preferably made of plastic material.

As seen in FIG. 3, an end cap or plug 42 is provided at the top of the inner container to seal off or close the refrigerant compartment and prevent mixture of the refrigerant with the beverage. If desired, the end cap or plug 42 can be permanently affixed by fusion or adhesion to the inner container. As an alternative, the plug can be made removable by providing it with threads (not shown) which interfit with threads on the inner container 22.

Figure 4:
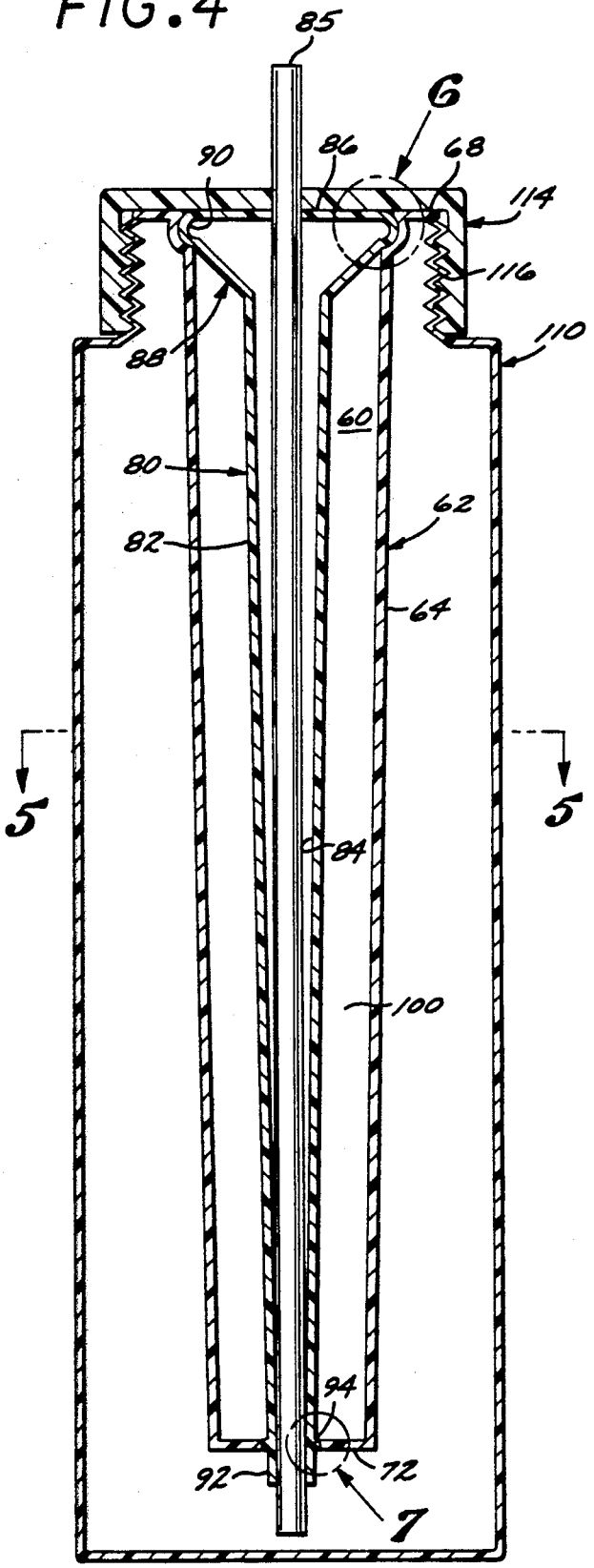
FIG. 4 is a view similar to FIG. 3, but illustrating another embodiment of the beverage cooler.
Figure 5:
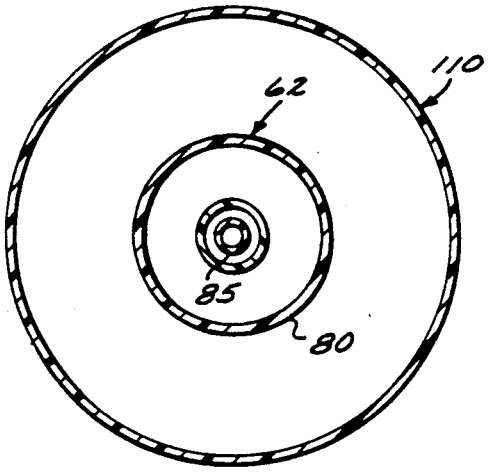
FIG. 5 is a cross sectional view taken from line 5—5 of FIG. 4.
Figure 6:
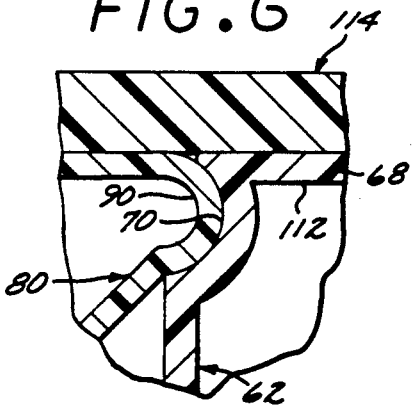
FIG. 6 is an enlarged detail view of the area designated by the numeral "6" in FIG. 5.

FIGS. 4, 5 and 6 show another embodiment in which the inner container is of two part construction. The container 60 comprises a first or outer tubular member 62 formed by a circumferential wall 64. It further comprises an inner tubular member 80.

The top of the outer tubular member 62 includes a peripheral flange 68 adapted to seat upon the upper end of the outer container 110. The base 72 of the tubular member 62 includes an opening 76 for receiving the lower extremity of the tubular member 80.

Figure 7:
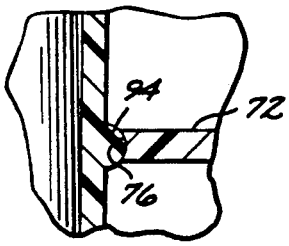
FIG. 7 is an enlarged detail view of the area designated by the numeral "7" in FIG. 5.

As best seen in FIGS. 4 and 7, the lower end of the inner tubular member 80 extends or projects below the base 72. The walls 82 of the inner tubular member 80 define a passageway 84 through which a drinking straw 85 can be disposed.

The margin defining the opening 76 in the base of the outer tubular member 62 includes a circumferential recess. A circumferential ridge 94 is provided on the inner tubular member 80 to snap fit into the recess and hold the inner tubular member 80 in position.

As seen in FIGS. 4, 5 and 6, a snap fit structure is provided at the top of the inner container. An annular recess 70 is provided in the upper portion of the peripheral wall 64 for receiving a ridge 90 provided on the inner tubular member 80.

The snap fit engagement of the top and bottom portions of the tubular members 62 and 80 provides a seal for sealing or closing the compartment 100 of the inner container 60.

Prior to assembly of the tubular members 62 and 80, the heat transfer medium or refrigerant can be placed in the compartment 100 through the upper open end of the tubular member 62. To reduce leakage of the refrigerant as it is poured into the compartment 100, the lower end of the inner tubular member 80 is first slipped into the opening 76. The inserted lower end has a diameter approximating that of the opening 76. To completely seat the inner tubular member 80 within the outer tubular member 60 after the compartment 100 is filled with refrigerant, member 60 is grasped and member 80 is pressed down. This slightly bends or deforms the margins of the lower opening 76, and thereafter interengages the snap fitting ridges and recesses. To disassemble the inner container 60, the lower portion 92 of the inner tubular member 80 is held against a hard surface. The outer tubular member is then be pushed down toward the hard surface which disengages the snap fitting ridges from their recesses. This makes it easy to clean the inner and outer tubular members whenever required.

The horizontal top portion 86 of the inner tubular member 80 is normally located flush with the flange 68 of the outer tubular member 62. Both the top portion 86 and the flange 68 are then engageable by the underside of the top 114. The top 114 is releasably mounted to the outer container 110 by any suitable means, such as by interfitting threads 116, as shown in FIG. 4.

In use, the inner container 22 or 62, as the case may be, is first separated from the top 34 or 114, filled with refrigerant, and then placed in a refrigerator or the like to cool the refrigerant. Because of its compact size, the inner container conveniently fits within a refrigerator freezer compartment.

The beverage is then poured to a suitable level in the outer container.

After the refrigerant is pre-chilled or frozen, the inner container is next placed within the outer container and secured in position by the top 34 or 114.

The main body of the beverage in the chamber between the inner and outer containers is cooled by the refrigerant. In addition, the refrigerant, being located adjacent the passageway for the drinking straw, further chills the beverage portion being withdrawn through the passageway by means of the straw.

While the description of the invention herein has been directed to a specific embodiment, various modifications can be made without departing from the spirit and scope of the invention. Accordingly, it is not intended that the invention be limited except as in the appended claims.

We claim:

1. A beverage cooler comprising:

a first container having walls defining a chamber for receiving a beverage;

a second container disposed within the first container and having walls defining a tubular passageway having an open lower end, the walls of the second container further defining an interior compartment surrounding the passageway for receiving a heat transfer medium to effect heat transfer between the heat transfer medium and beverage passing through the tubular passageway; and means fixing the second container against movement relative to the first container.

2. The beverage cooler according to claim 1 wherein the last mentioned means comprises a top securing and suspending the second container within the first container.

3. The beverage cooler according to claim 2 wherein the second container and the top includes interfitting threads.

4. The beverage cooler according to claim 2 wherein the last mentioned means further comprises mounting means for releasably mounting the top to the first container.

5. The beverage cooler according to claim 4 wherein the mounting means comprises interfitting threads on the top and the first container.

6. The beverage cooler according to claim 2 wherein the second container has an upper portion including a flange adaptable to engage the first container.

7. The beverage cooler according to claim 1 wherein the walls defining the tubular passageway comprise a tubular member fitted within and releasably coupled to the second container, and wherein the upper and lower extremities of the tubular member include ridges received within complemental recesses defined in the upper and lower extremities of the second container.

8. The beverage cooler according to claim 1 wherein the walls defining the tubular passageway comprise a tubular member fitted within and releasably coupled to the second container, and wherein the last mentioned means includes a top securing and suspending the second container within the first container.

* * * * *